United States Patent [19]

Lippert

[11] 4,125,580

[45] Nov. 14, 1978

[54] PROCESS FOR THE MANUFACTURE OF PRETENSIONED CARRIAGEWAY SLABS

[75] Inventor: Erich Lippert, Wessling, Germany

[73] Assignee: Dyckerhoff & Widmann Aktiengesellschaft, Munich, Germany

[21] Appl. No.: 792,512

[22] Filed: May 2, 1977

[51] Int. Cl.[2] ..... E04B 1/16

[52] U.S. Cl. ..... 264/34; 264/228; 404/47

[58] Field of Search ..... 264/228, 34; 404/47; 14/16.5

[56] References Cited

U.S. PATENT DOCUMENTS

| | | | |
|---|---|---|---|
| 2,286,019 | 6/1942 | Smith | 404/47 |
| 2,655,846 | 10/1953 | Freyssinct | 264/228 |
| 3,022,713 | 2/1962 | Friberg | 264/228 X |
| 3,089,215 | 5/1963 | Stubbs | 264/228 X |
| 3,245,328 | 4/1966 | Fassbinder | 404/47 |

*Primary Examiner*—Thomas P. Pavelko

*Attorney, Agent, or Firm*—Frank L. Durr; Orville N. Greene

[57] ABSTRACT

A method of forming a carriageway slab comprising two or more sections with expansion joints between the sections and stressed longitudinal tensioning members extending all the way through the sections is provided. In such structures, the space between sections where the expansion joints are provided is too small to insert a press to provide necessary stress to the longitudinal tensioning members. According to the invention, the tensioning members are formed in two parts, one part of each (a longer part) extending rearwardly from the front end plate of a section and the other or shorter part extending from the rear end plate. The front portion of the section is concreted and when the concrete is hardened, the tensioning members are stressed at the end of the concreted part and fixed in stressed condition, then the shorter parts of the tensioning members are attached to the corresponding longer parts and tension is applied to the shorter sections while the position of the adjacent ends at the joint is fixed. When the concrete is hard, the attachments of the parts at the joint is loosened so that the tension originally applied to the short parts is now at least partly applied to the concrete.

4 Claims, 5 Drawing Figures

PROCESS FOR THE MANUFACTURE OF PRETENSIONED CARRIAGEWAY SLABS

The invention concerns a process for the manufacture of a longitudinally and transversely prestressed carriage-way slab or the like, which is subdivided into individual sections through expansion joints wherein in the area of each expansion joint, a joining structure from the adjacent part on the interface of the section on which the longitudinal tensioning members are fastened and a cover plate for bridging over the joint gap are arranged which is fastened on one of these parts so that longitudinal changes in the carriageway slab, such as occur through temperature fluctuations, enables one section of the slab to slide with respect to the other sections.

With prestressed carriageway slabs, it is often difficult to apply stress to the tensioning members. The carriage slabs are made in individual sections one after the other, whose lengths amount to 100 to 120 meters. In order not to delay the work progress, the application of tension to the tensioning members of one section must await the hardening thereof before the next section can be concreted. It is thus necessary to subsequently stretch the longitudinal tensioning members in the built-in state. At the same time, the longitudinal tensioning members should naturally traverse the total length of all sections so that the total length of the structure will be subjected to prestressing.

It is known (U.S. Pat. No. 3,194,129) to arrange in the area of the expansion joints which have a hollow space open at the top, longish steel parts on whose rear walls, at times, a tension member is anchored. The anchoring is slanted upwardly so that in this hollow space, a tensioning press to stretch the respective tensioning members can be attached. The hollow space is subsequently covered with a steel plate. As a result of the large and complex steel parts, this method is relatively expensive. Besides the leading out of the tension members slantingly is disadvantageous because by this means the bending moment in the carriageway slab may be encroached upon.

Furthermore, it is known (U.S. Pat. No. 3,022,713) to lead the longitudinal tensioning members in a carriageway slab up almost to the expansion joint structure, to leave the upwardly open space in the slab alone and to concrete the former after tensioning the tension members. By operating in this way, no direct connection of the tension members to the joint construction is possible so that between respective tension members and the joint constructions, an intermediate area remains which is not prestressed. Besides, in this construction, the tensioning press cannot be connected in the plane of the tensioning members, but can be siezed from above the carriageway slab only through an auxiliary structure on the latter.

This invention is based on the problem of finding a possibility of making a carriageway slab wherein each individual section can be prestressed along its entire length whereby the tensioning members extend in one plane within the carriageway slab and are connected directly at the interfaces of the individual sections of adjacent parts of the joint constructions so that the pretensioning will be provided from the interface of these sections along the complete length of the same.

According to the invention, this problem is solved by leaving a narrow connecting gap on the carriageway slab upon concreting each section, which after the hardening of the concrete of this section, the longitudinal tensioning members arranged in jackets in which they are movable longitudinally are intermediately anchored so that afterwards separate tendons, arranged in the gap connected at one end with the carriageway slab can be connected at the other end with the already tensioned longitudinal tension members, that these tendons afterwards are stressed against reciprocally restrained parts of the joint construction and that then the gap is filled with concrete and after the hardening thereof, the restraining parts of the joint construction are loosened.

The tendons, which suitably are formed similarly to the longitudinal tensioning members, can be solidly fastened to the joint structure, e.g. welded thereon, and be connected to the longitudinal tensioning members through a tensioning turnbuckle.

Satisfactory tensioning members are hot rolled rods which have been provided with a series of ribs extending along a screw line and forming a thread on the rod.

The advantage of the invention consists primarily in that tensioning members passing through the entire length of each section are provided, (which the up-to-the-present expansion joint constructions do not have), so that the sections can actually be stressed throughout their total length. This is obtained according to the invention by making each of the longitudinal tensioning members in each section in two parts, with a substantially long part reaching over the greatest part of the length of each section long parts being stressed, as the stressing members in the stressed concrete are known to be, after being injected with cement, and with a shorter part which shorter parts are stressed after the tensioning of the long part and are concreted in the stressed condition. Since with this shorter part, the necessary stretching for tensioning is only slight, it can be carried out without more ado in the existing narrow space maintained with its original spacing. With regard to the quality, the carriageway slab obtained by these measures likewise is advantageous since a correspondingly broader continuous section over the total breadth of the carriageway slab is afterward concreted in the full breadth of the slab and a correspondingly greater section can be made with better quality concrete than is permitted in the supplementary filling of the gap.

The invention will be further explained with the aid of the drawings. In the drawings.

Figure 1:
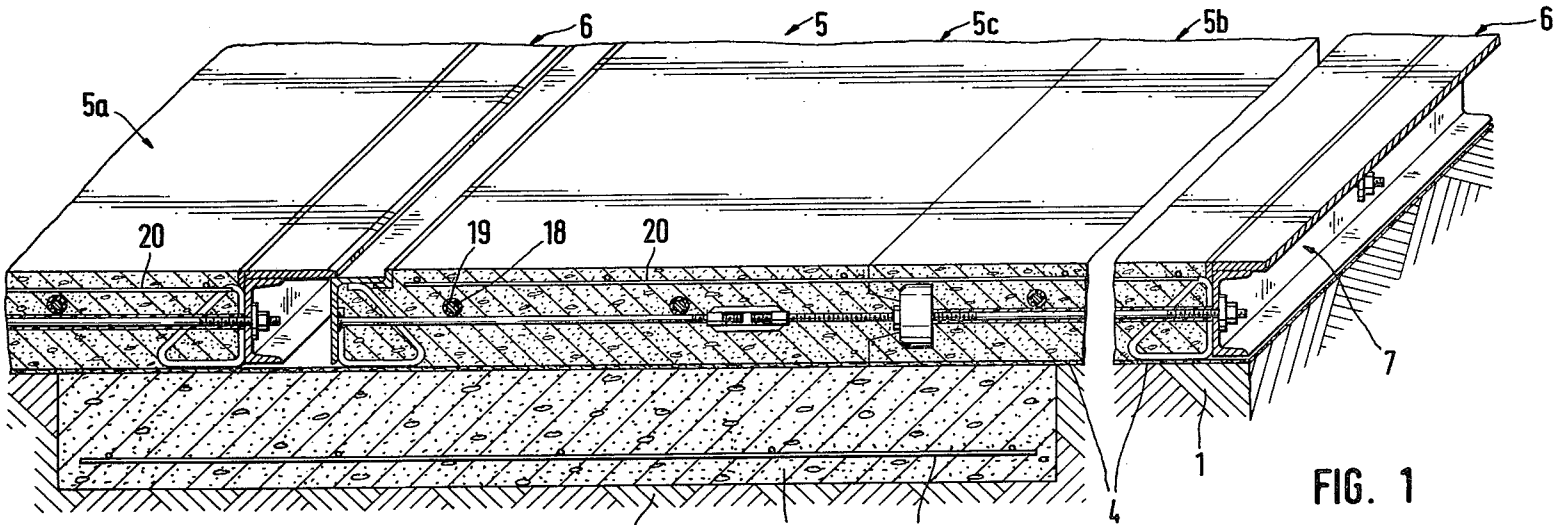
FIG. 1 is a partial longitudinal section in three-quarters view, of a carriageway slab made according to the invention.

For the manufacture of a carriageway slab according to the invention, the basement soil 1 is first established on the subsoil and leveled fine and even through a consolidation of gravel or sand ballasting. At the place where an expansion joint is to be later provided in the carriageway slab produced, a bench 2 is provided of reinforced concrete in order to prevent an accidentally occurring irregular settlement in the jointing area. As reinforcement, a reinforcing mesh 3 is embedded therein. On the basement soil 1 and over the bench 2, a slipway sheet 4 is then spread in order to guarantee not only that the carriageway slab to be placed here is not tied together with the subsoil, but also that these can expand or contract longitudinally with respect to one another, which occurs with the tensioning by the stressing member and by temperature fluctuations. This slipway sheet 4 consists of a layer of special paste, a foil or the like.

Thereafter, the essential carriageway slab 5 can be produced. To this end, the joint structure 6 is next built in, which forms at its front end a sheathing for the roadway segment. Each joint construction 6 consists of a channel bar 7 which is provided with a number of stirrups 8 welded thereon for anchoring in the concrete. At the upper leg 9 of the channel member, a cover plate 10 is attached (e.g. screwed on) which bridges the groove 11 and slides on the upper leg 12 of the angle bar 13 whose vertical leg 14 forms the shuttering for the following segment of the carriageway slab 5. Also, on the angle bar 13, stirrups 15 are welded for anchoring in the concrete.

In each segment of the carriageway slab, longitudinally extending stressing rods 16 are provided. The stressing rods or tendons 16, which are threaded on at least one end, are passed through borings in the web of the channel bar 7 and are anchored at the inner side of the latter by means of an anchor plate and a threaded nut. As tensioning rods, there is advantageously used those which are provided with ribs by a heat rolling process which ribs occur in a spiral, so as to form a screw thread. Additionally, there are provided (1) transversely extending tensioning rods 18 which likewise are formed similarly to the longitudinal rods 16 and also likewise repose in sheaths 19, and (2) a slack, non-stressed reinforcement, e.g. a reinforcing mesh 20.

Figure 2:
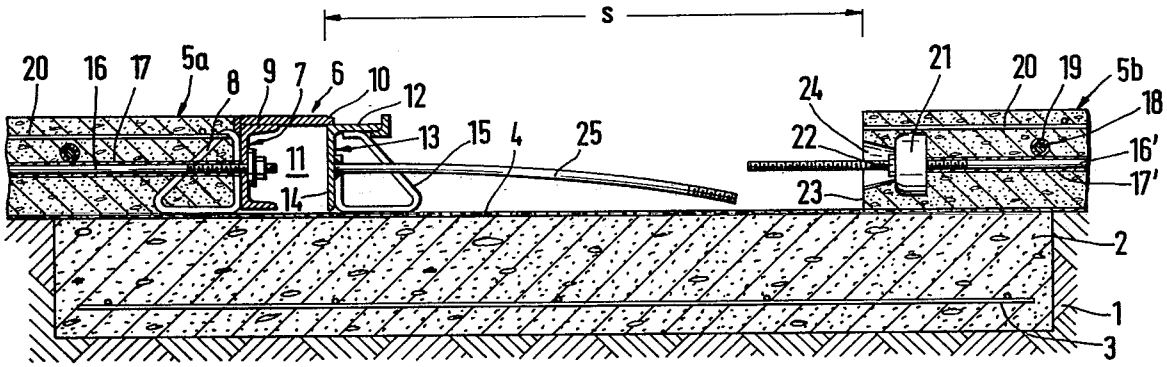
FIGS. 2 and 3 are partial longitudinal views thereof in different phases of manufacture.

The manufacture of a carriageway slab, according to the invention, can be followed with the explanation as illustrated in FIG. 2. In this figure, the jointing structure 6 has been built in and the concrete for the carriageway slab 5*a* has been brought in. Then the tensioning members 16' with the sheaths 17' for the next carriageway slab 18 and the reinforcing mesh 20 have been installed. The tensioning rod 16' is anchored at the end with an anchoring body 21 and anchoring nuts 22. Then the concrete for the section 5*b* has been introduced. The concrete thereby reaches only up to an interface 23 which leaves empty a space "S" of the jointing structure. In the area of this interface 23, the tensioning rod 16' projects a certain distance from the recess 24 which serves for attaching to a tensioning press (not shown) at the free end in over the length S.

Figure 3:
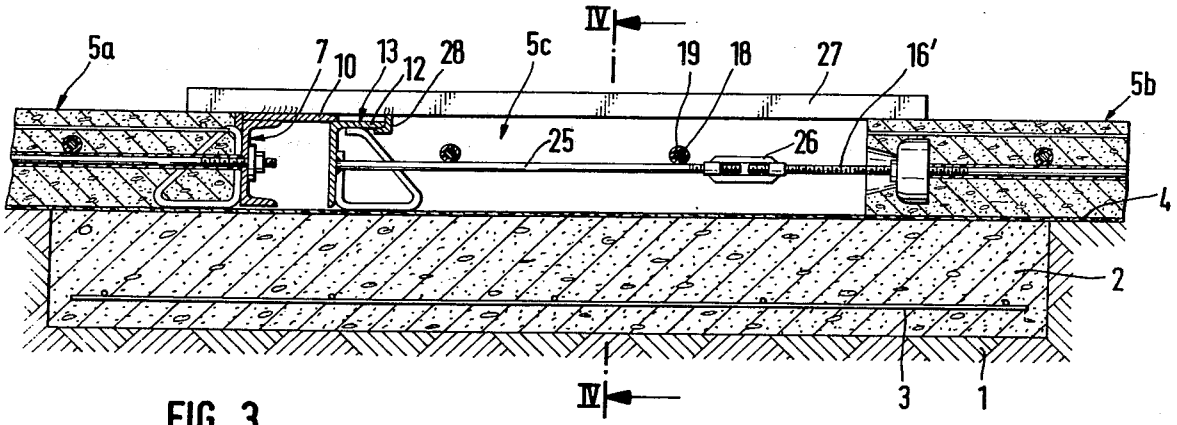
Figure 4:
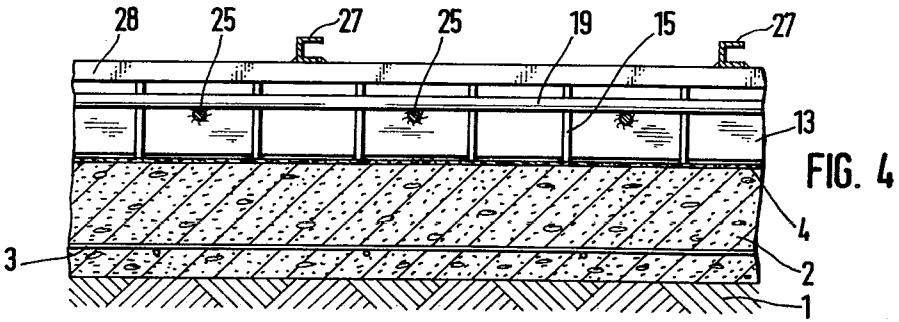
FIG. 4 is a cross-sectional view thereof taken along line IV—IV of FIG. 3.
Figure 5:
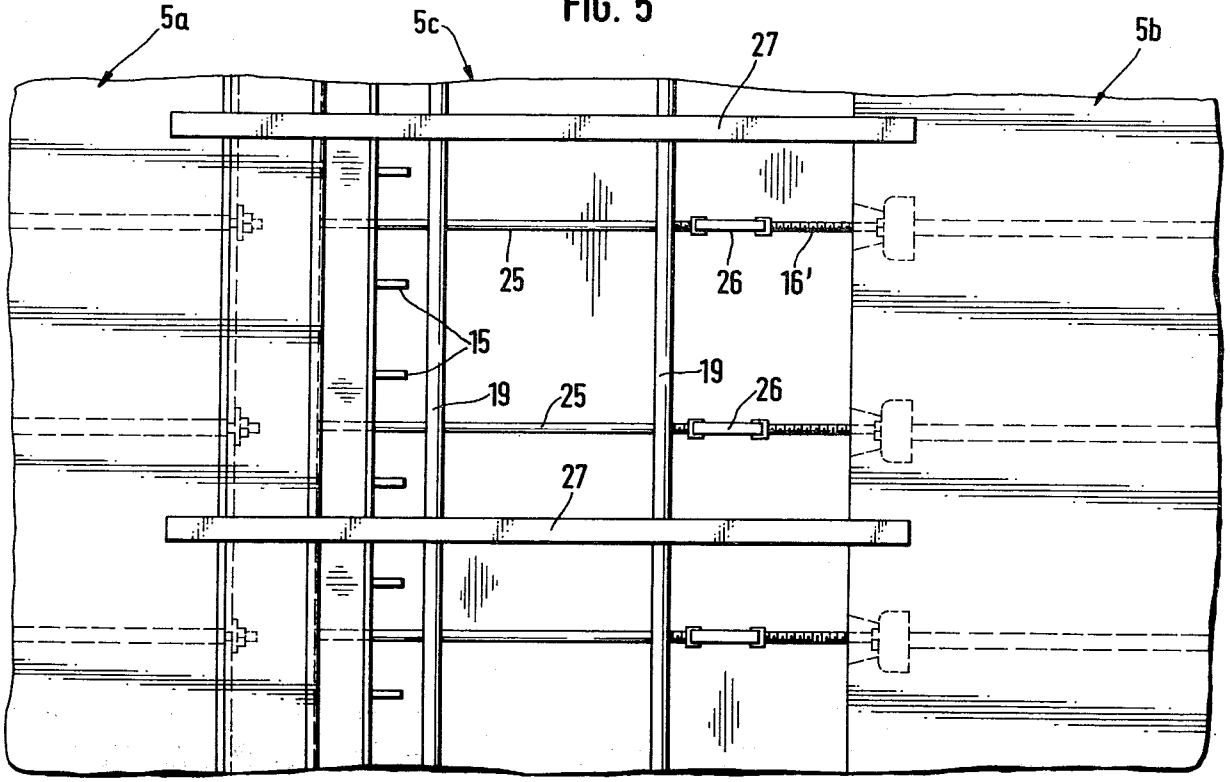
FIG. 5 is a plan view of the carriageway slab in the area of the expansion joint of FIG. 3.

After the concrete of the section 5*b* has hardened, the tension members 16' are stretched and anchored on the anchoring body 21 with the anchoring nuts 22. Then, additionally, steel rods 25 which have already previously been fastened to the angle bar 13, e.g. by screwing, and bent up from their position to clamp on rods 16' and connected to rods 16' through the locking device or turnbuckle 26. The additional steel rods 25 are appropriately formed similarly to the stress rods 16 or 16'. These are then stretched by means of the locking device. For this purpose, both parts 7 and 13 must, among other things, have their positions fixed with respect to one another in the joint construction 6 (FIG. 3). This fixing in position can be obtained with the steel channel bars 27 which are welded onto the angle bar 28 or angle bar 12, as well as onto the cover plate 10.

Afterwards, also transverse tension rods 18 in sheaths 19 are also introduced, and the concrete for the intermediate section 5*c* can then be introduced. After the hardening of the concrete of this intermediate section 5*c*, the fixing of the joint construction is loosened, i.e., the steel channel bars 27 are knocked away whereby the tension applied to the steel rods 25 is transferred to the angle bar 13 and to the concrete.

Therefore in the final stage, the total carriageway sections 5*b* and 5*c* are prestressed over their total length to an approximately similar degree (FIG. 1).

The invention is not limited to the employment for carriageway slabs. It can obviously be made in a similar way for air traffic surfaces, or generally, for any length of a grounded concrete plate to be made in this way.

I claim:

1. Process for the manufacture of carriageway slab or the like which comprises at least two sections, each of which are prestressed throughout their length and breadth and including expansion joints between the sections, each expansion joint comprising the end plates of the two sections separated by a groove and covered by a bridging plate attached to one of the end plates and under which plate the end portion of the adjacent section is slidable, the improvement comprising concreting the main portion of a new section except for a relatively small portion adjacent the expansion joint, said main portion containing embedded jacketed tensioning rods extending from the end plate opposite the expansion joint and into the non-concreted portion of the section, tensioning said tensioning rods and fixing them under tension at the end of said concreted portion, said end plate adjacent said expansion joints containing tendons extending toward the ends of the tensioning rods in the non-concreted area, fixing the position of the two end plates at the expansion joint with respect to each other, securing the ends of the tendons to the ends of the corresponding tensioning members and placing the tendons under tension, concreting the space remaining in said section and then releasing the plates at the expansion joints whereby by the tension applied to the tendons is applied to stress the last applied concrete.

2. The process as claimed in claim 1 wherein said tensioning rods and said tendons are formed of the same type of rods each with threaded ends.

3. The process as claimed in claim 2 wherein the position of the two end plates at the expansion joint is fixed by welding at least two restraining bars to the two parts thereof and wherein said tensioning rods are connected to said tendons, the latter stressed by means of a turnbuckle.

4. The process as claimed in claim 1 wherein said tensioning members are formed by hot rolling and are provided with ribs extending in a spiral line around the rod providing a screw-thread therefor.

* * * * *